US006216871B1

(12) United States Patent
Bacques et al.

(10) Patent No.: US 6,216,871 B1
(45) Date of Patent: Apr. 17, 2001

(54) PACKAGE AND METHOD FOR PACKAGING OF BATCHES OF ARTICLES OF UNDETERMINED VOLUME

(75) Inventors: Jean-Yves Bacques, Paris; Guy Coalier, Noce; Jean-Claude Serre, Dijon, all of (FR)

(73) Assignee: Otor, Paris (FR)

( * ) Notice: Subject to any disclaimer, the term of this patent is extended or adjusted under 35 U.S.C. 154(b) by 0 days.

(21) Appl. No.: 09/284,167

(22) PCT Filed: Oct. 13, 1997

(86) PCT No.: PCT/FR97/01829

§ 371 Date: May 19, 1999

§ 102(e) Date: May 19, 1999

(87) PCT Pub. No.: WO98/16434

PCT Pub. Date: Apr. 23, 1998

(30) Foreign Application Priority Data

Oct. 11, 1996 (FR) ..... 96 12428
Nov. 13, 1996 (FR) ..... 96 13856

(51) Int. Cl.[7] ..... B65D 71/10; B65D 5/56; B65B 53/02

(52) U.S. Cl. ..... 206/497; 53/442; 229/164.2

(58) Field of Search ..... 206/497, 495; 53/441, 442; 229/164.2

(56) References Cited

U.S. PATENT DOCUMENTS 3,385,424 * 5/1968 Thompson et al. ..... 206/497 X
3,442,372 * 5/1969 Carmichael et al. ..... 206/497 X
3,519,160 * 7/1970 Lorenz, Jr. et al. ..... 229/164.2
3,586,233 * 6/1971 McCulloch .
3,927,821 * 12/1975 Dunning ..... 229/164.2
4,133,430 * 1/1979 Cravers ..... 206/497
4,328,896 * 5/1982 Behne ..... 206/497
4,571,232 * 2/1986 Diehl ..... 229/164.2
4,757,900 * 7/1988 Misset et al. ..... 206/497
5,086,925 * 2/1992 Coalier et al. ..... 206/497
5,323,896 6/1994 Jones .

FOREIGN PATENT DOCUMENTS 81 15 943 5/1981 (DE) .
91 05 265 4/1991 (DE) .
0 228 331 12/1986 (EP) .
0 323 354 12/1988 (EP) .
0 447 282 2/1991 (EP) .
0 712 784 7/1991 (EP) .
0 577 457 6/1993 (EP) .
0 694 480 7/1995 (EP) .
2 426 620 5/1978 (FR) .
2 506 722 6/1981 (FR) .
2 577 519 2/1985 (FR) .
2 589 444 10/1985 (FR) .
2 577 001 12/1985 (FR) .
2 593 781 2/1986 (FR) .
2 661 392 4/1990 (FR) .
2 703 656 4/1993 (FR) .
87/02644 10/1986 (WO) .

* cited by examiner

*Primary Examiner*—Bryon P. Gehman
(74) *Attorney, Agent, or Firm*—Merchant & Gould P.C.

(57) ABSTRACT

The invention is a packaging case made of cardboard for transporting a load, a method and a device for packaging such a case. The case includes a lateral band (2, 3, 4, 5) and a horizontal base (6) integral with the band via joining lines, and a heat shrinkable plastic film material (7, 8, 9) for packaging and holding the load securely. The case also includes at least one rigid mounted plate (11), pressing the heat shrinkable film on the internal face of the base of the case leaving free strips of material arranged for blocking the load by shrinking on the film, the plate being inserted between at least two first vertically opposite walls of the case such that the edges of the plate are in contact via the plastic film with at least part of the joining lines of the first walls. The case further includes structure for blocking the plate against the base.

19 Claims, 10 Drawing Sheets

PACKAGE AND METHOD FOR PACKAGING OF BATCHES OF ARTICLES OF UNDETERMINED VOLUME

Figure 1:
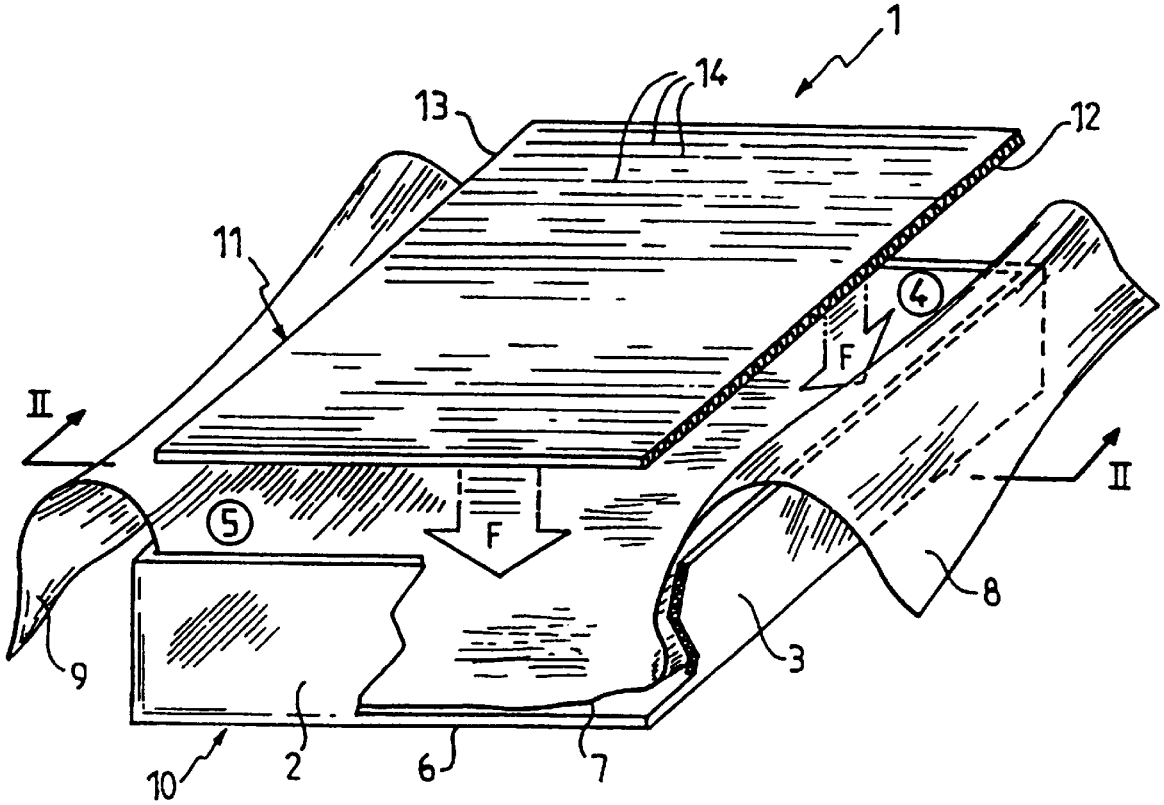

The present invention relates to a pack of the type comprising a cardboard box provided with a shrinkable film which is integral with it, said pack being intended for the packaging of articles intended to be delivered in highly variable numbers or volumes.

It also relates to a method and an apparatus for forming a packaging pack of the type comprising a cardboard box provided with a shrinkable film It has a particularly important, though not exclusive use in the field of the transport of heavy objects, that is to say of a weight greater than one kilogram, for example three kg, five kg, ten or even thirty kg, and of irregular shape.

Such packaging is also particularly suitable for objects, such as boxes, bottles, drugs or else various documents, taken as a group or unit by unit in the same pack which is particularly intended for delivery to a retailer, such as a book seller or pharmacist and, more generally, the retail trade.

It will easily be understood that wholesalers, in order to prepare the orders from their retailers, need to package batches of inherently widely differing articles in packs which must, nonetheless, withstand sometimes difficult transport and delivery conditions; in view of the cost of standard boxes, it quickly became difficult to use such packs for packaging batches of articles of this kind, since this would presuppose resorting systematically to ranges of packs, the storage of which would be extremely costly and therefore unsuitable for this form of distribution.

Many solutions to this type of problem are already known, and, for a long time, these have proposed packaging the batches of articles inside a box or tray, especially made of cardboard, which is covered with a heat-shrinkable plastic sheet connected to the inner face of the bottom of the box and/or to the inner face of the two opposite vertical walls; it is thus sufficient for the objects to be packaged to be arranged inside a cardboard bottom, and for them subsequently to be covered with the plastic sheet which, finally, will be shrunk completely onto the products, for example as a result of passage through a heating tunnel, the result of this being that said products are kept firmly stowed against the transport box. Such solutions are normally highly advantageous, since they require only a single box with a minimum volume of cardboard, thus bringing about substantial savings in terms of material, in addition to obvious savings in the storage of now only a single pack.

French patent FR-2,426,620 is known in this connection, according to which two plastic sheets are used for packaging a batch of products, said sheets overlapping one another, at one of their ends, on top of the Load, so as to be hot-welded to the latter in the region of the overlap zone, their other end, which is not in contact with the load, being adhesively bonded to the inner face of the bottom or, in the vicinity of the bottom, to the inner face of a side wall of a cardboard box obtained from a simple blank forming the bottom of the box, from which bottom extend two lateral faces which are previously folded down onto the load, before the two plastic sheets, which will retain the assembly as a whole by welding, are folded down. This particular pack has the disadvantage of a serious lack of mechanical stability of the assembly as a whole; in fact, the entire packaging is linked to the detachment or tear resistance of the connections of the plastic sheets to the bottom or side walls of the cardboard box. It is well known that such packs are subjected to high stresses during handling and transport, these often leading to the breakage of the connections of the plastic films to the cardboard base.

Other solutions have been proposed in this respect, these being based, this time, on the surprising discovery that the detachment or tear resistance of the sheetlike heat-shrinkable materials during the handling and/or transport operations was improved when the connection of said heat-shrinkable materials to the box was made outside said box on at least one outer face (bottom or side wall) of the latter, that edge of said face which is covered with said sheetlike heat-shrinkable material acting as a means for opposing the stresses exerted by the weight of the Load.

Several solutions have already been proposed in this regard, especially in French patent FR-A-86,01435, which describes a packaging box consisting of a case, for example made from cardboard, and of a sheetlike heat-shrinkable material for packaging a load and for keeping the latter in place, characterized in that the sheetlike heat-shrinkable material is connected by means of at least one of its borders to the outer surface of a wall of the case in the vicinity of the edge of said wall and is deployed, on the outside, from said border toward the edge of said wall and then, on the Inside of the easer opposite the inner surface of said wall, at the same time moving away from the latter toward the load to be packaged. A similar solution is found, moreover, in French patent FR-A-85,16217, according to which the heat-shrinkable sheets are inserted between the inner faces of the walls and portions of these same walls, said portions being folded toward the interior of the box.

These last solutions have the disadvantage either of requiring a cover, in the first case, or of providing, at the outset, a special cut-out which is costly In terms of material and generates extra cost in the management of stocks of such packs; furthermore, these solutions are more complicated in mechanical terms, in as much as they require two plastic sheets which appreciably complicate the assembly operations. Another solution was proposed in French patent FR-2,577,001, which describes an American or joined-together American boxes which are closed by means of an independent adhesively bonded lid.

A method for the packaging of batches of products of various volumes is also known (FR-A-2,661,392), in which a wedge is pushed into a box, at the same time driving a plastic film. The film is arranged and projects transversely on either side of the wedge, which is less wide than the inner dimension to the box in the transverse direction and which comprises longitudinally, on its two opposite sides, two elastic wings or flaps locked by a spring effect, via locking tongues, in complementary orifices in the walls of the previously formed box.

Such a method does not make it possible to obtain a pack capable of holding objects of great weight.

A packaging box for small parts of any shape is also known (DE 81,15,943), said box being provided with a sleeve or bag made of heat-shrinkable plastic and with one or more superposed pallets which are introduced with an appropriate fit into the sleeve and box.

Here, too, such a pack has disadvantages. Its production cannot be mechanized, especially in view of the difficulty of introducing the pallet into the sleeve or bag, and it is appropriate only for small objects (for example, screws).

The documents DE-U-8115943 and FR-A-2,661,392 describe packs with a board and plastic film which can hold only small objects and/or do not sufficiently withstand difficult transport conditions.

Advantageously, the rigid board is a plane board when it is flat and devoid of flaps, that is to say the transverse and longitudinal lateral peripheral portions of which are not connected to the central part of the board by means of folding or grooving lines, for example in order to form wings which are deformed elastically during introduction into the box.

In other words, the board has a transverse dimension equal to or greater than the inner transverse dimensions of the box, that is to say the distance separating the transverse edges which are in contact and round which the plastic film passes is at least equal to the inner transverse dimensions of the box.

By inner transverse dimensions of the box is meant the shortest distance separating the inner faces of two opposite walls in the transverse direction.

It will easily be understood that such a solution has many advantages, as compared with all the prior teachings, in as much as it is possible to equip any cartons, boxes, trays or cases forming a receptacle with a heat-shrinkable film intended for enveloping any load, without the risk of problems of detachment or tearing during handling or in the case of shocks in the course of transport; likewise, the solution recommended by the invention is suitable both for continuous production, in as much as a shrinkable film in one niece is used, or for entirely manual and one-off production, since it is sufficient to provide, in addition to a reel of heat-shrinkable film, plane elements which, at the appropriate moment, are cut to the dimensions of the bottom of the tray, box or any other container made of compact corrugated cardboard or another sheetlike material, the film and board being assembled simply by forced or slanted or, at the very least, contact insertion between two opposite side walls of the container to be equipped.

Of course, according to another important characteristic of the invention, the plane element forming the double bottom of the container is obtained from a simple corrugated cardboard blank, of which it is expedient simply to orient the directions of the flutes exactly, as will be explained later.

Moreover, in advantageous embodiments, use is made of one and/or the other of the following arrangements:

in order at least partially to form the blocking means, the lower face of the board is at least partially directly adhesively bonded to the upper face of the bottom of the box, through at least one recess of the rim or on a surface devoid of film.

Advantageously, the upper face of the box is adhesively bonded to the lower face of the board through a plurality of small recesses.

Likewise advantageously, the faces are adhesively bonded through a wide central orifice of the film, said orifice confronting the center of the board and being, for example, circular or oval and having a maximum transverse dimension of five to ten centimeters.

In order to form the recesses, the film is also, for example, perforated in the form of a plurality of orifices pierced by heating or punching, for example in the form of crescents, arranged in the vicinity of the joining lines, for example at one or two centimeters from said joining lines of the first walls, adhesive bonding of cardboard to cardboard taking place through the orifices, additional adhesive bonding of the film of plastic material likewise being capable of being carried out as a result of the overflow of glue under and over the peripheries of the orifices;

the blocking means consist at least partially of the first walls, the board having a dimension a little greater than the distance between said first walls, so that said board is wedged forcibly between said first walls after insertion;

in order at least partially to form the blocking means, the board comprises, on at least one of its two opposite edges, at least one tenon, said tenon co-operating with a corresponding recess made in the region of the joining line with the bottom of the first confronting wall, in order to bring about the snapping engagement of the board, once the latter is in place against the bottom of the box;

the recess consists of a groove of a height equal to or substantially equal to the thickness of said board and extending over part of the length of said joining line;

the blocking means comprise portions of inner tabs directly adhesively bonded to the inner faces of said first vertical walls, the lower periphery of said inner tabs coming into abutment with the upper edges of the board in order to ensure said blocking;

the blocking means comprise flaps attached to the upper peripheries of the first walls by means of folding lines;

the blocking means comprise flaps attached to the lateral peripheries of the second walls directly or indirectly adjacent to the first walls.

By indirectly adjacent is to be meant a wall which would, for example, be separated from the first wall by a corner cut;

the blocking means comprise flaps attached to the lower peripheries of the first walls by means of folding lines forming at least partially the joining lines with the bottom, said flaps each comprising a tongue detachable from said flap, but remaining attached to said joining lines, and fastened to the bottom of the box formed by two other flaps, said flaps being folded down and, for example, fastened on top of the board by adhesive bonding;

the film of heat-shrinkable material is in one piece;

the board is made of corrugated cardboard, of which the direction Of the flutes is perpendicular to the contact lines with the first vertical walls, between which said board is inserted;

the board completely covers the bottom of the box in order to form a double bottom;

the box is produced from a blank comprising a series of tabs which terminates in a fastening tongue, said tabs being connected to one another by means of first folding lines parallel to one another, and a first set of lateral flaps arranged on one side and connected to the main tabs by means of second folding lines which form said joining lines, are perpendicular to the first folding lines and are intended at least partially for forming the bottom of the box, said second folding lines being aligned, and said box being arranged so as to be assembled automatically by the folding down of said tabs and of the flaps of said first set around a mandrel, the end tab of the series of tabs and the tongue, on the one hand, and the adjacent flaps, on the other hand, being fastened to one another by adhesive bonding in order to form said box;

the series comprises eight tabs, specifically four main tabs separated in pairs by four intermediate tabs.

It goes without saying that the embodiments more particularly described here, which are half boxes, are intended to form boxes according to the invention and, for this purpose, comprise lids known per se, which consist, for example, of flaps connected to the walls by means of folding lines or of an attached lid in the form of a board connected to a wall by means of a folding line or not.

The invention also proposes a method for forming a packaging box made of cardboard or the like for the transport of a load, as described above.

Advantageously, the method comprises the following steps:

the bottom and the vertical walls of the box, which is left open on top, are formed, a composite element is formed, comprising the board and the plastic material integrally fixed at least temporarily to said board or not, and the composite element is introduced forcibly or aslant until it comes into a position blocked in abutment against the bottom of the box, before the top of said box is closed by a flap being folded or a lid being put In place, after the introduction of the load and heat sealing.

In another advantageous embodiment, the method comprises the following steps:

the bottom and the vertical walls of the box, which is left open on top, are formed, then, the film of plastic material is introduced and the board is introduced forcibly or aslant onto the plastic material until said board comes Into a position blocked in abutment against the bottom of the box, before the formation of the pack is completed, as described above.

Advantageously, since the film has previously been perforated in order to form a plurality of orifices which are for example aligned or staggered in parallel and are substantially in the vicinity of those edges of the board which are likely to confront the lines joining the bottom with the first walls, glue is injected through these orifices onto the cardboard of the board or of the bottom located underneath, before the plastic material is laid onto the board or the bottom and before said composite element formed by the board and he applied film, or the board alone if the film is already introduced and laid onto the bottom, is introduced into the box.

In an advantageous embodiment, the bottom and the walls of the box are formed around a mandrel.

Advantageously, before the bottom and the walls of the box are formed, the composite element is laid onto the bottom of the mandrel, and the box is subsequently formed from above.

In another embodiment, the bottom and part of the vertical walls of the box, which is left open on the side, are formed, a composite element is formed, comprising the board and the plastic material integrally fixed at least temporarily to said board, and the composite element is introduced into said box from the side, before said side is closed.

The invention also proposes an apparatus for the production of a packaging box made of cardboard or the like for the transport of a load, said box comprising a lateral enclosure formed from at least four vertical walls and from a horizontal bottom integrally fixed to said enclosure via joining lines, and a filmlike heat-shrinkable plastic material intended for packaging said load and for keeping the latter in place, characterized in that it comprises means for forming the bottom and the vertical walls of the box, means for presenting a composite element comprising a board superposed on the plastic material which is integrally fixed at least temporarily to said board or not, and means for introducing the composite element into said box forcibly, with slight friction, or aslant, until the heat-shrinkable film is laid onto the inner face of the bottom of the box, so as to be sandwiched relative to said board, at the same allowing two curtain portions of free material to escape on either side of two mutually confronting opposite edges of the board, said curtain portions extending from said edges over a length sufficient to cover one another, at the same time completely enveloping a load to be introduced, means for blocking said load as a result of the hot welding and heat-shrinkage of the film, said means being capable of laying said element in place by pressing on the attached rigid board, and means for closing the top of the box.

The board and the half box are thus arranged in such a way that the board is inserted between at least two first opposite vertical walls, so that two edges of the board are in contact, via the film of plastic material, with at least part of the joining lines of said first walls, and is then held in a position blocking the board against the bottom.

Advantageously, the apparatus comprises adhesive bonding means allowing direct adhesive bonding between part of the lower face of the board and of the upper face of the bottom of the box through the film.

In an advantageous embodiment, the apparatus comprises means for forming the bottom and the walls of the box around a mandrel.

Likewise advantageously, it comprises means for laying the composite element onto the bottom of the mandrel.

Figure 2:
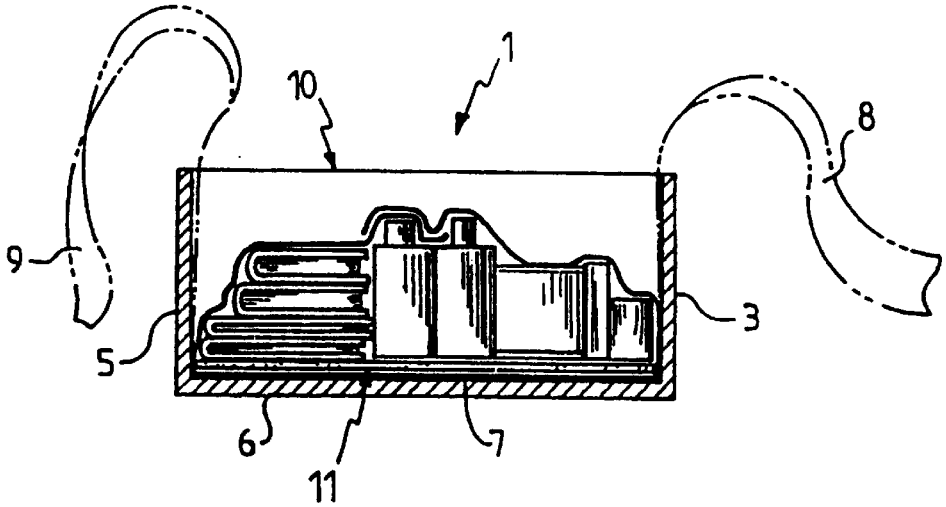
Figure 3:
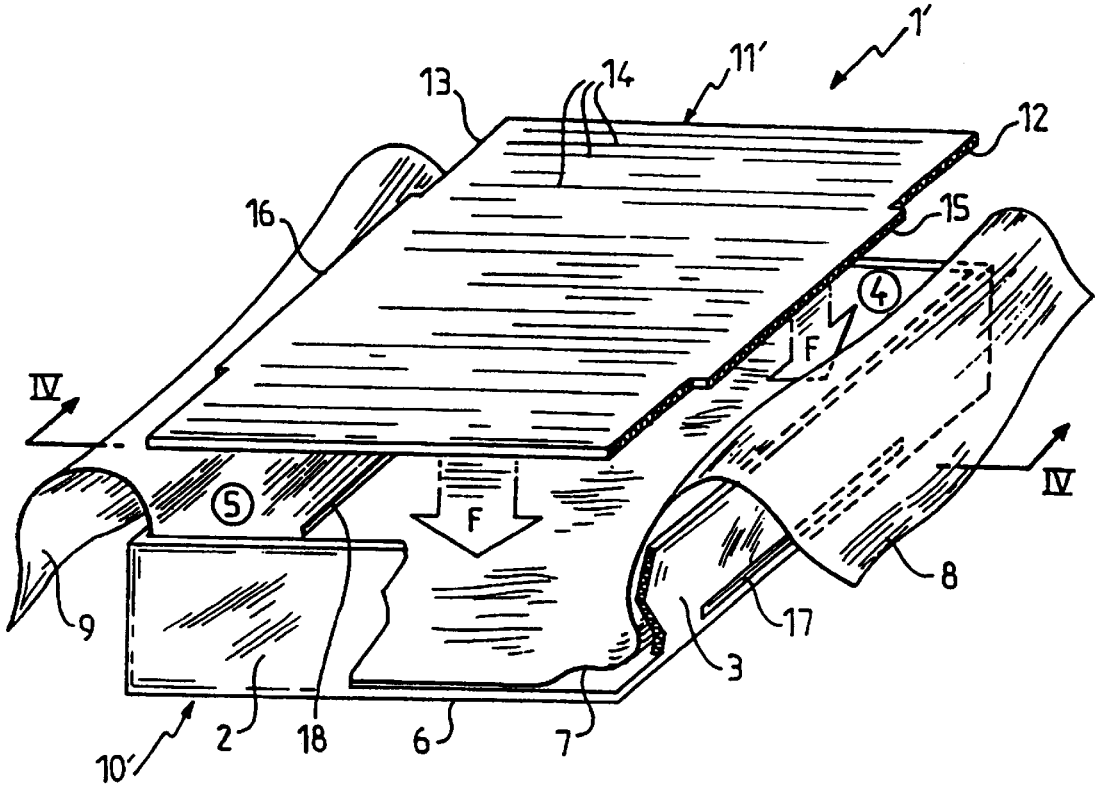
Figure 4:
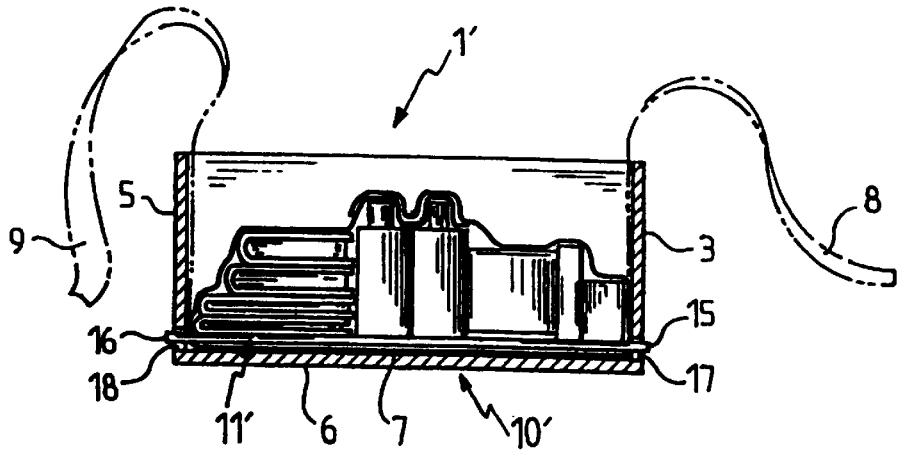
Figure 5:
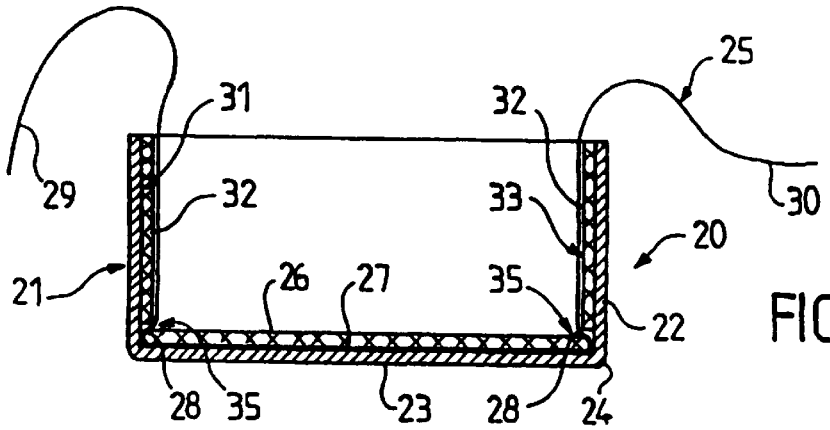
Figure 6:
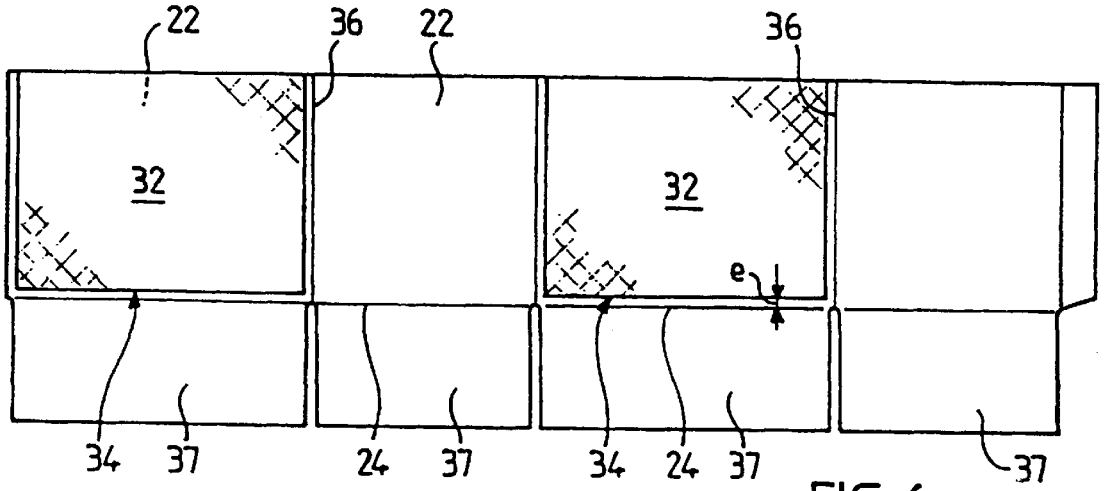
Figure 7:
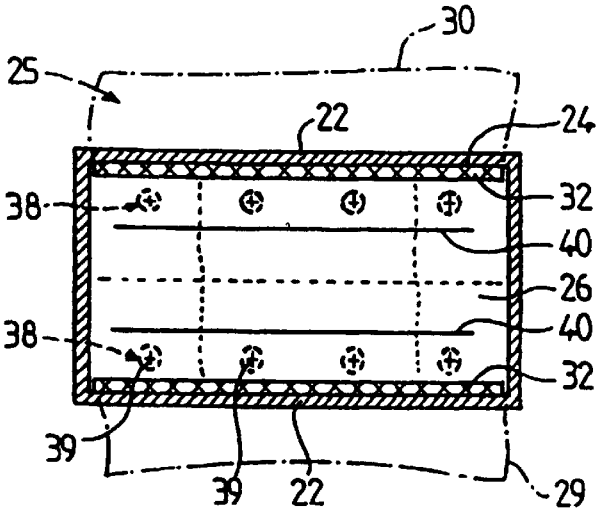
Figure 8:
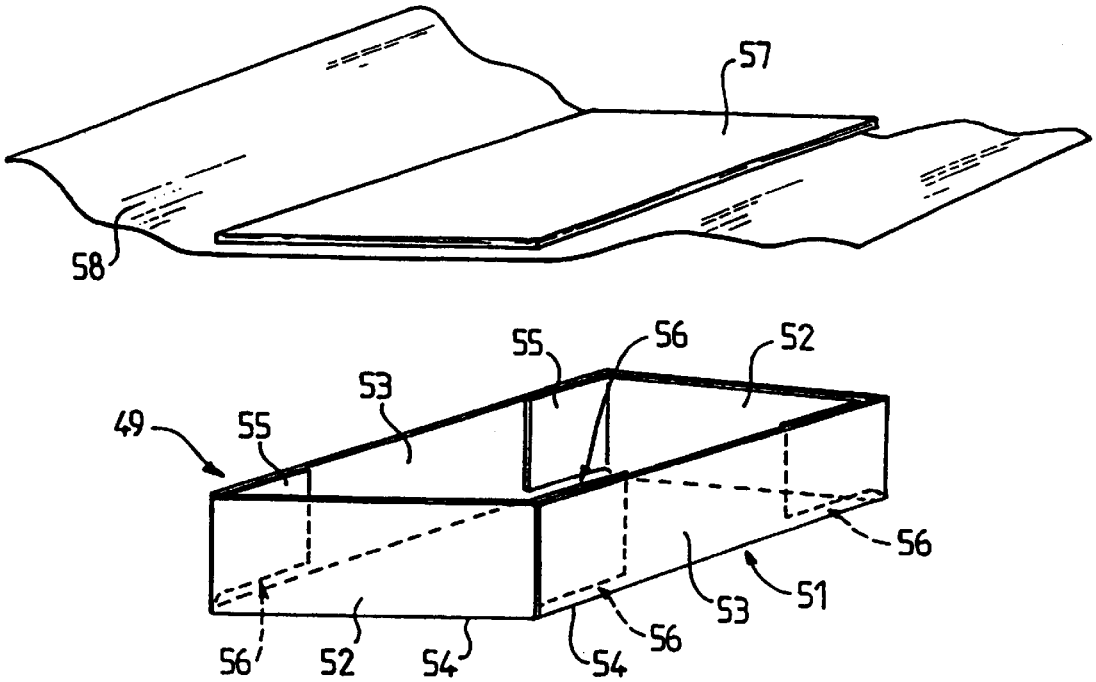
Figure 9:
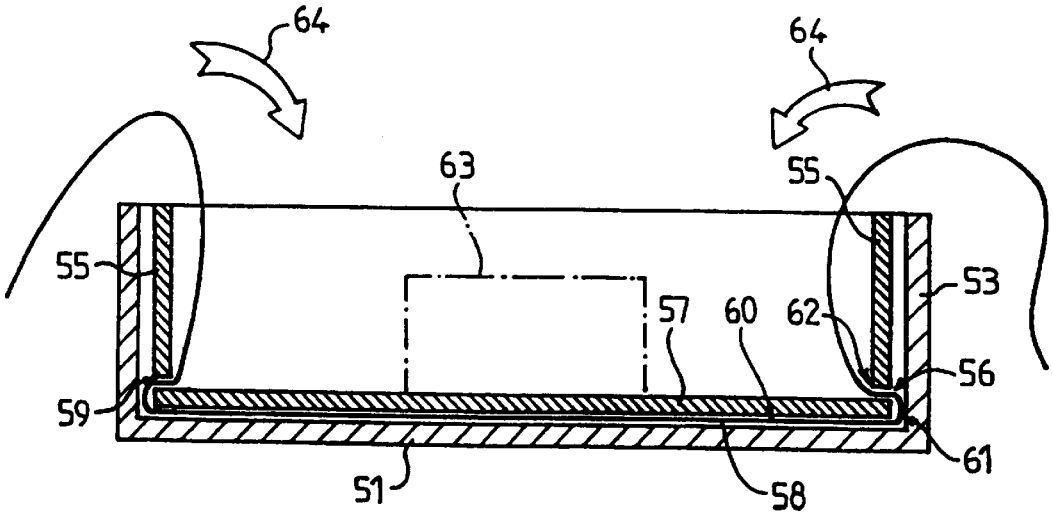
Figure 10:
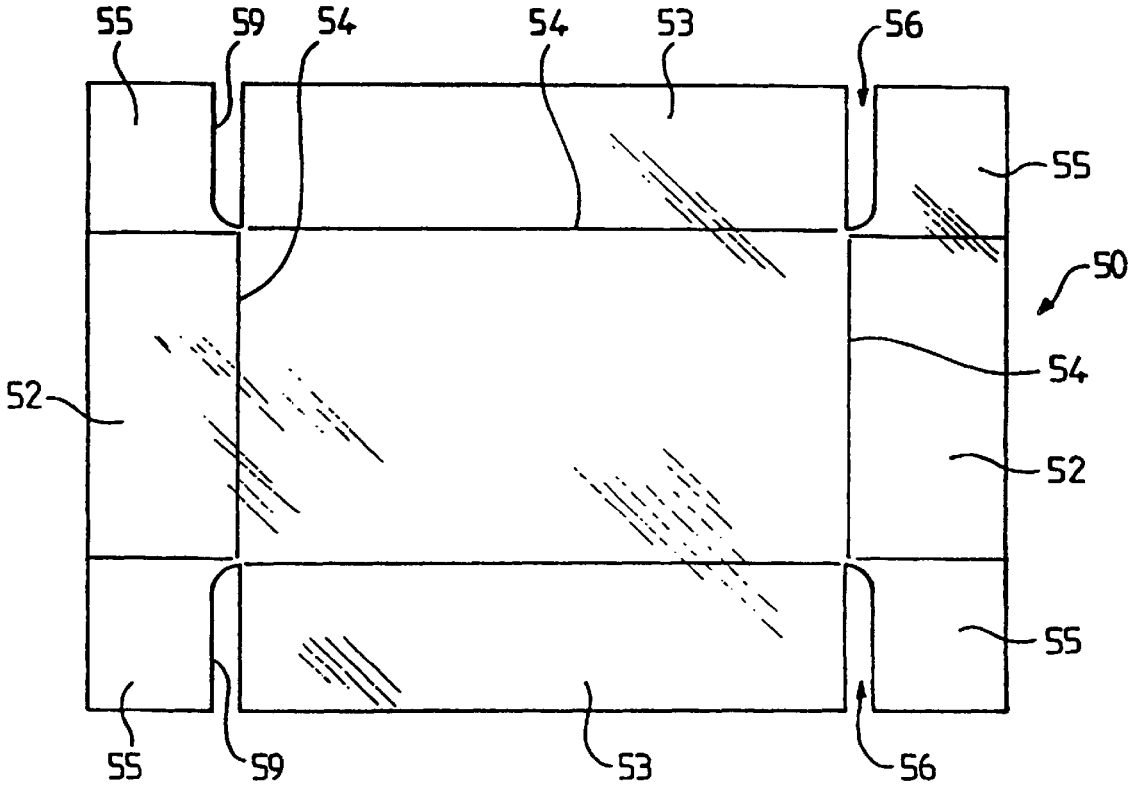
Figure 11:
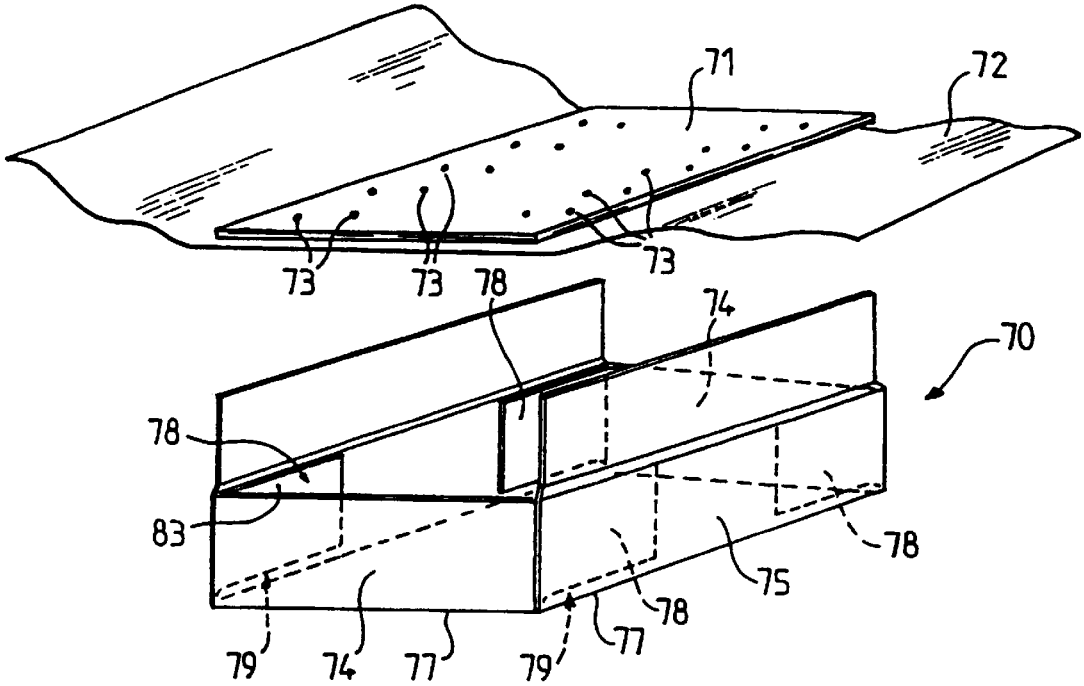
Figure 12:
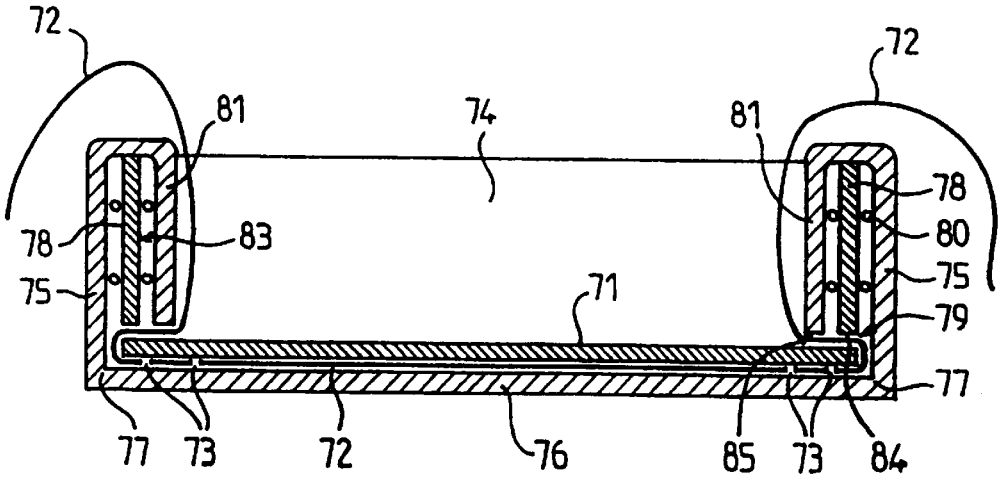
Figure 13:
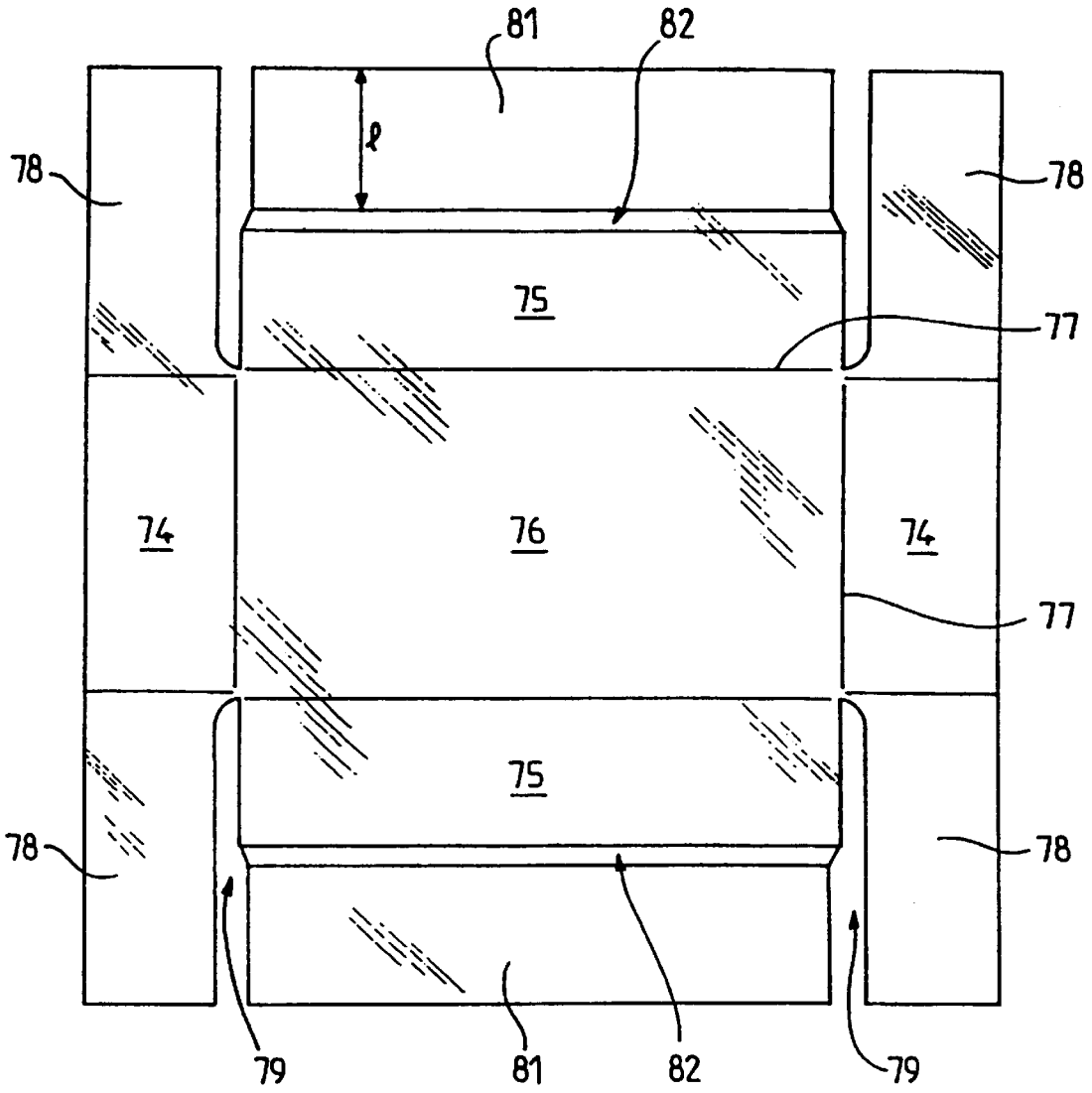
Figure 14:
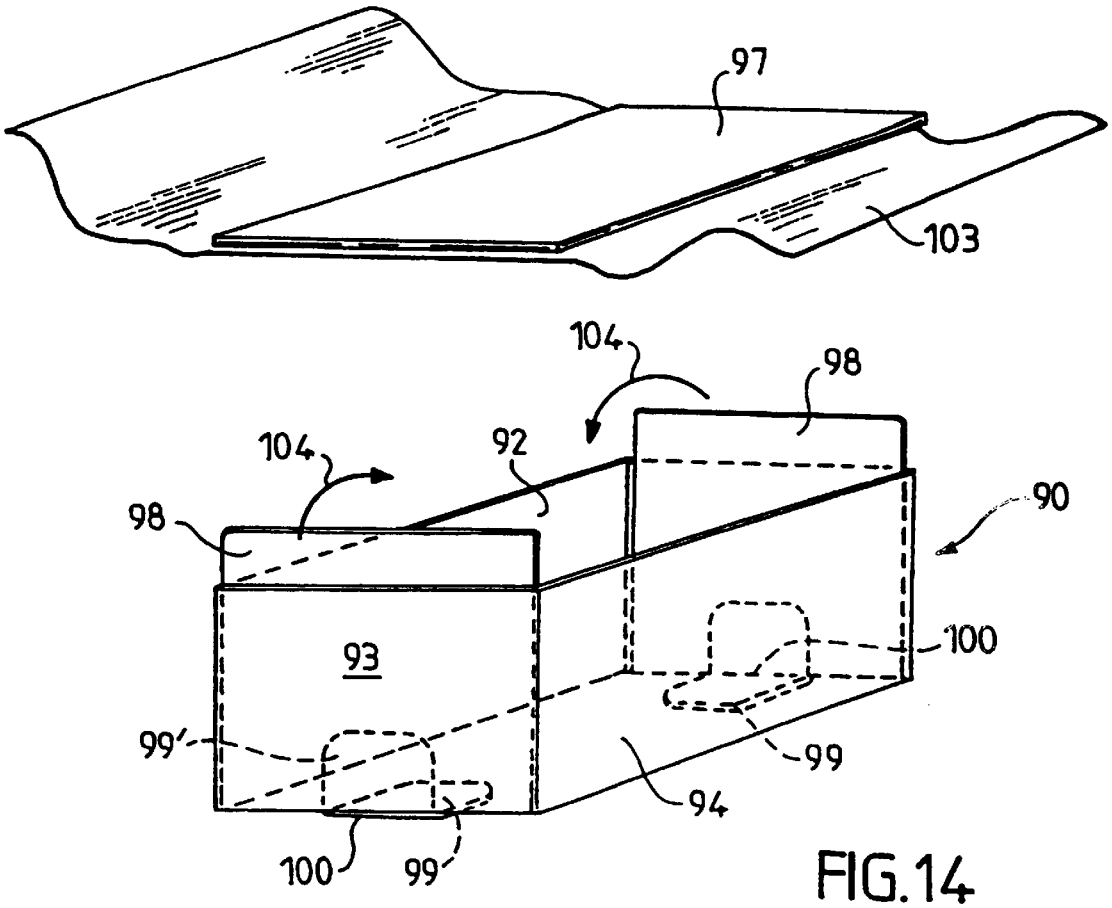
Figure 15:
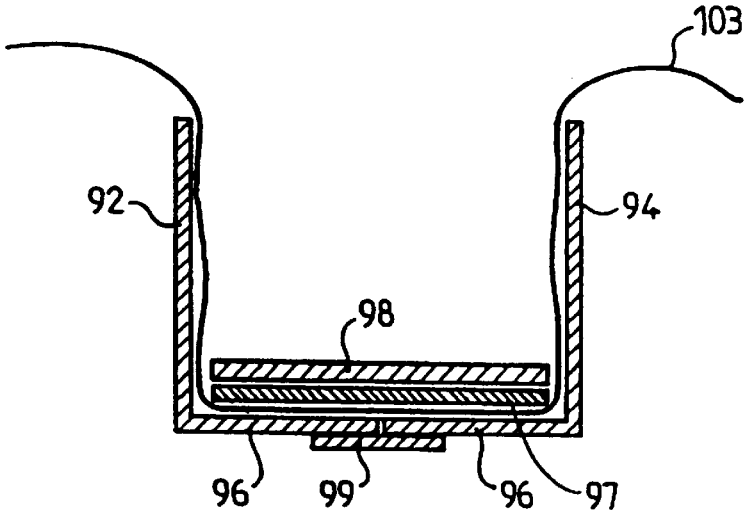
Figure 16A:
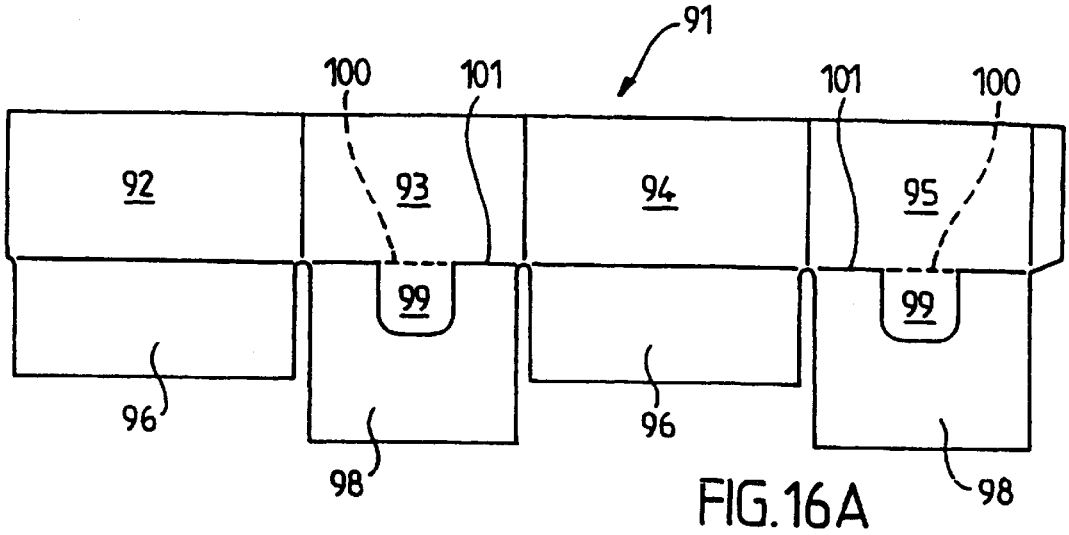
Figure 16B:
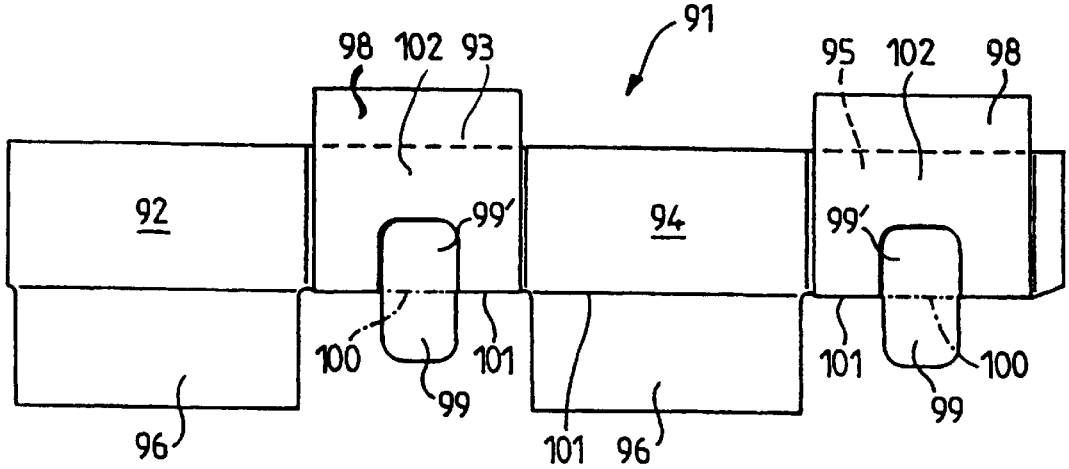
Figure 17:
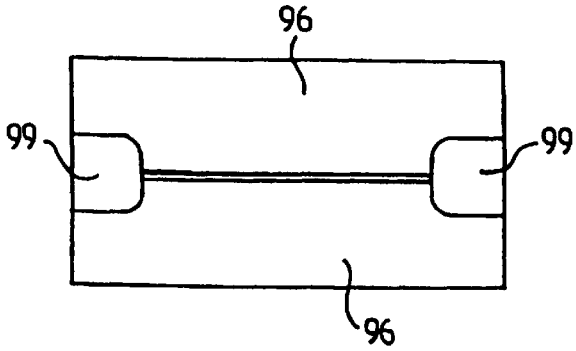
Figure 18:
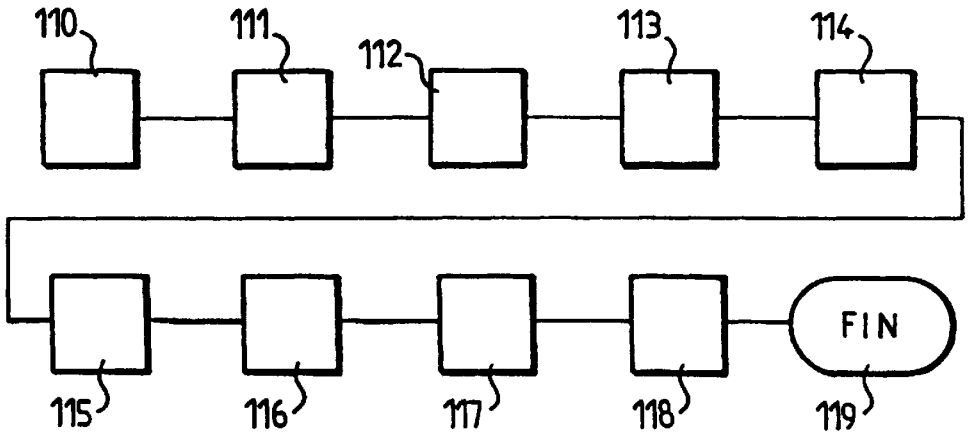
Figure 19:
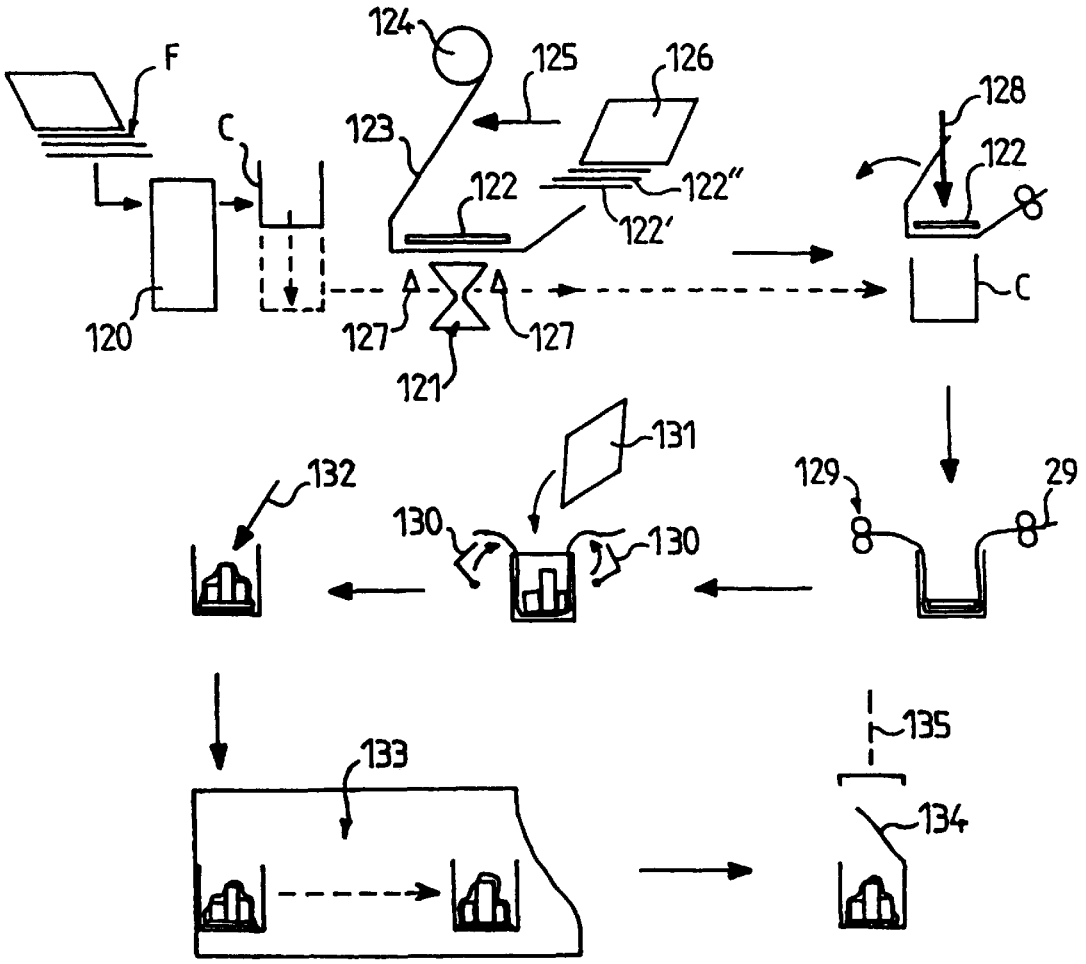

Other advantages and characteristics may be gathered wore clearly from the following description of several embodiments of the box according to the invention, with reference to the accompanying drawings in which:

FIG. 1 is a perspective view of a half box according to a first variant of the invention, showing the component elements of the half box, before assembly according to the arrows F, FIG. 2 is an elevation view of a section II—II of FIG. 1, when the board forming a double bottom is sandwich-laid onto the bottom of the box; furthermore, unbroken lines illustrate some of the articles after the heat-shrinkage of the plastic film and thin broken lines illustrate the two curtains of plastic before the loading of the articles, FIG. 3 is a perspective view of a second variant of the half box according to the invention showing the board forming a double bottom, before assembly according to F and before the snapping engagement of the double bottom between two opposite vertical walls of the box, FIG. 4 is a sectional view IV—IV from FIG. 3, unbroken lines showing the half box with its snap-engaged double bottom and broken lines showing the two curtains of plastic before the loading of the articles, FIG. 5 is a lateral sectional view of another embodiment of a half box according to the invention, FIG. 6 is a plan view of the blank making it possible to obtain a half box corresponding to FIG. 5, FIG. 7 is a top view of the half box of FIG. 5, FIG. 8 shows a perspective view of a board/film assembly and of the primary box or container intended for forming a half box according to another embodiment of the invention, FIG. 9 is a sectional view of the half box of FIG. 8, FIG. 10 is a plan view of the blank making it possible to obtain the box of the half box of FIG. 8, FIG. 11 shows a perspective view of a board/film assembly and of the box according to another embodiment of the invention, FIG. 12 is a sectional view of the half box of FIG. 11, FIG. 13 is a plan view of the blank making it possible to obtain the box of the half box of FIG. 11, FIG. 14 shows a perspective view of a board/film assembly and of the box according to another embodiment of the invention, FIG. 15 is a sectional view of the half box 33 of FIG. 14, FIGS. 16A and 16B show two plan views of the blank, before the folding of the flaps and after the folding of the flaps, making it possible to obtain the box of the half box of FIG. 14, FIG. 17 is a bottom view of the half box of FIG. 14, FIG. 18 is a block diagram showing the steps of an embodiment of the method according to the invention, FIG. 19 is a basic diagram of an apparatus according to an embodiment of the invention.

According to FIGS. 1 and 2, the box 1 for packaging a batch of articles, corresponding to the preparation of an order, comprises, according to a first variant of the invention, an enclosure, made of corrugated cardboard or the like, which is formed from four panes 2, 3, 4, 5, for example rectangular, arranged vertically and integrally fixed to one another along help length, the mutually confronting walls 2, 4 and 3, 5 normally, though not necessarily, being identical., so as to form in space a right-angled parallelepiped; this enclosure is provided, in its lower part, with a bottom 6 integrally fixed in any known way to each of the walls 2, 3, 4, 5, in order to form an upwardly open receptacle 10. It is perfectly clear that the receptacle 10 may be obtained from a simple American half box or from an American box without the upper flaps or else from a tray having a 25 bottom adhesively bonded, for example, to support pieces; the choice of a parallelepiped box 1, which corresponds to the great majority of uses, is not limiting, of course, and it would be perfectly possible to envisage producing receptacles 10 comprising more than four vertical walls, in order to meet particular need in the field of handling or transport.

Arranged, first of all, inside the receptacle 10 is a sheet of heat-shrinkable plastic 7 of a dimension such that it covers substantially the bottom said 6 of said receptacle, whilst at the same time spreading along two opposite vertical walls 3,5 in order to project to a great extent beyond the box 1 and form two curtains 8, 9 which, once the load is deposited in the receptacle 10, will cover the objects, with a minimum overlap between the two curtains 8, 9, so as to bring about a sealing weld after passage through a heating tunnel, as will be stated later.

A flat and rigid element 11 is subsequently inserted forcibly inside the receptacle 10 provided with its heat-shrinkable film 7, the two curtains 8, 9 of which have been folded down outside the vertical walls 3, 5, so as to sandwich-lay the film 7 onto the bottom 6 of the receptacle. Of course, the element 11, which comes to lock the film 7 at the bottom 6 of the receptacle 10, is correctly dimensioned so as to be forcibly inserted between the two vertical walls 3, 5 straddled by the two curtains 8, 9, thus bringing about a genuine wedging of the film 7 between the edge 12 of the element 11 and the wall 3 and between the edge 13 and the wall 5 respectively.

It would easily be understood that such assembly, which is particularly easy to carry out, is an effective solution for packaging a batch of articles of indeterminate volume which it is sufficient to arrange on the upper face of the element 11 and cover by means of the two plastic curtains 8, 9, so as to obtain firm and sealing packaging, after heat-shrinkage in a tunnel, for example heating the film 7 and the two curtains 8, 9 arranged with a slight overlap.

According to an alternative embodiment of the box according to the invention, it is perfectly possible, in addition to adhesive bonding of the element 11 to the bottom 6 of the receptacle 10, to carry out adhesive bonding which will take place through the film 7.

According to a general characteristic of the invention, the plane element 11 must be rigid so as to bring about maximum blocking of the film 7 between the vertical walls 3, 5 of the receptacle 10; advantageously, this plane element 11 will be cut out from corrugated cardboard, preferably, though not necessarily, to the dimensions of the bottom 6 of the receptacle 10, in order to form a genuine double bottom. So as to impart the necessary rigidity to the corrugated cardboard, the plane element 11 will be inserted in such a way that the direction of the flutes 14 is perpendicular to the contact lines with the vertical walls 3, 5, between which said element 11 is forcibly inserted.

According to FIGS. 3 and 4, a second variant of the box according to the invention will now be given, and it will be seen that those parts of FIGS. 3 and 4 which are common to both variants bear the same references as in FIGS. 1 and 2.

As in the first variant, the receptacle 1 will advantageously be formed from four side walls 2, 3, 4, 5, preferably of rectangular shape, which are held relative to one another so as to form an enclosure, for example made of corrugated cardboard or the like, integrally fixed to a bottom 6 in order to form, in a highly conventional way, a receptacle 10', such as an American box without upper flaps or an American half box or else a tray with single walls or double walls which is commonly used in the field of packaging.

As in the preceding variant, a sheet of heat-shrinkable plastic 7 is arranged inside the receptacle 10', the two ends of said sheet forming curtains 8, 9 of free material which project to a great extent on either side of the receptacle 10', beyond two opposite vertical walls 3, 5, over a length making it possible to cover completely the articles to be packaged, as already explained above.

In this second variant, the plane element 11', which, as in the preceding variant, sandwich-lays the central part of the film 7 onto the bottom 6 of the receptacle 10', has, of course, all the characteristics of the plane element 11 of the first variant, but it is additionally provided with tenons 15, 16 which extend outward in the plane of the element 11' from the opposite edges 12, 13 of said element 11' which come into contact with two side walls 3, 5 of the receptacle 10', said walls contributing to blocking the two curtains 8, 9.

These two tenons 15, 16 on the element 11' are intended to co-operate with two grooves 17, 18 extending horizontally at the base of the two opposite vertical walls 3, 5 of the receptacle 10', in order to lock the element 11' by snapping engagement after it has been introduced forcibly and sandwich-laid onto the bottom 6 of the receptacle 10'.

The two grooves 17, 18 are made in the lower part of the vertical walls 3, 5, just above the joining line between said walls 3, 5 and the bottom 6, over a length at most equal to the length of said walls and normally over a length sufficient to keep the element firmly the bottom 6 of the in against C receptacle Thus, the element 11', snap-engaged in the grooves 17, 18 of the opposite side walls 3, 5, not only, with its edges 12, 13, sandwich-clamps the film 7 against the same vertical walls 3, 5, but, by virtue of the action of the two tenons 15, 16, forms wedges which irreversibly embed the base of the curtains 8, 9 in the grooves 17 and 18. Thus, any pull on the film 7, for example in the event of a fall, shock or abrupt handling, will be compensated not only by the wedging effect of the piece 11', as in the first variant, but also by the wedge effect of the tenons 15, 16 embedded in the grooves 17, 18 of the vertical walls 3, 5.

It will be understood, then, that, in this variant, it is possible to avoid completing the fastening of the heat-shrinkable film to the bottom 6 of the receptacle 10' by adhesive bonding, if the loads are not too heavy. Such assembly of the element 11' in the receptacle 10' by snapping engagement is particularly suitable for a receptacle of the tray type with double walls, making it possible to mask externally the two grooves 17, 18 made solely on the inner face of the vertical walls 3, 5.

Alternative embodiments could, of course, be envisaged, which, for example, provide for only a single wall 3, 5 to comprise a groove 17 or 18, even if such assembly is obviously less reliable than that just described.

Here, too, the element 11' must have obvious 5 rigidity for the reasons already mentioned with regard to the first variant. For this purpose, the tenons 15, 16 will be cut out in the direction of the flutes, that is to say in the extension of the two edges 12~13 sandwich-blocking the two curtains 8, 9 on the opposite side walls .3, 5.

It is quite clear that none of the solutions derived from either one of the variants, with or without the snapping engagement of the plane element 11, 11' for example by replacing either one of the tenons 15~16 by a plurality of successive tenons on one and/or the other of the edges 12, 13 of the element 11', would go beyond the scope of the invention, an average person skilled in the art being able to extrapolate accurately the two main variants described below; nor would any particular embodiments go beyond the scope of the invention which aimed at obtaining a box of polygonal general shape, that is to say comprising more than four faces, in as much as the element 11 or 11' can be inserted between two walls which are not necessarily parallel, but bring about mutual sandwich-clamping of the heat-shrinkable film 7 between said element and said vertical walls, before the blocking of the element 11.

The invention can be applied particularly to the preparation of one-off orders, the content of which is variable and therefore cannot be fixed in advance.

FIG. 5 illustrates a parallelepipedic packing half box 20 made of cardboard or the like, for the transport of a load, said half box comprising a lateral enclosure 21 formed from four vertical walls 22 and from a horizontal bottom 23 formed by four flaps and integrally fixed to said enclosure via joining lines 24, and a filmlike heat-shrinkable plastic material 25 intended for packaging the load (not illustrated) and for keeping the latter in place.

The half box comprises an attached rigid rectangular board 26 laying the heat-shrinkable film onto the inner face 27 of the bottom of the box, at the same time allowing curtain portions 29 and 30 of free material to escape on either side of two mutually confronting opposite edges 28 of the board, said curtain portions extending from the edges 28 over a length sufficient to cover one another, at the same time completely enveloping the load and blocking said load as a result of the heat-shrinkage of the film.

The board 26 is inserted between at least two first opposite vertical walls, in such a way that said edges are in contact or substantially in contact via the film of plastic material 25 with at least part of the joining lines 24 of said first walls.

By "in contact via the film" is to be meant, throughout the text, flush with the plastic film, itself in contact with the joining line, and/or, preferably, pressing on the plastic film, which is itself in contact with the joining line.

The box comprises means 31 for blocking the board 26 against the bottom 23.

The blocking means 31 comprise portions of inner tabs 32 directly adhesively bonded to the inner faces 33 of the first vertical walls 22, the lower periphery 34 of the inner tabs coming into abutment with the upper edges 35 of the board in order to ensure blocking, thus wedging the plastic film 25 between the lower edge of the tabs 32, the inner face of the first wall and the end of the upper face of the edge of the board.

More specifically, with reference to FIG. 6, the half box is formed from a blank comprising the four rectangular walls 22 separated by vertical folding lines 36 and provided with a lower rectangular flap 37 which is intended for forming the bottom 23 and which is attached to the lower part of the box by means of a folding line 24 aligned with that of the adjacent flap.

Two inner tabs 32 adhesively bonded to two nonadjacent walls are provided.

They are, for example, rectangular and of an area a little smaller than that of the walls 22 in question.

The lower periphery 34 of the tabs is located at a distance e corresponding to the thickness of the board 26 which slides into abutment under said peripheries.

FIG. 7 is a top view of FIG. 5, showing the two mutually confronting walls 22, each provided with two inner tabs 32 for blocking the board 26 against the bottom consisting of the flaps 37.

Moreover, the plastic film 25 (represented by broken lines in the figure) is pierced with circular orifices 38 of small diameter, for example four orifices arranged on a line parallel to the joining line 24, at a distance from the latter of 1 to 5 cm, for example 2 cm.

The orifices have one or two centimeters.

Glue spots 39 have been injected through, allowing the direct adhesive bonding of the lower face 25 of the attached board 26 to the plane upper face of the large contiguous flaps 37 which form the upper part of the bottom, the small flaps themselves being folded on the outside and adhesively bonded.

In one embodiment, the plastic film 25 is 30 likewise adhesively bonded, on one or both of its sides, to the adjacent cardboard faces, for example by means of two lines 40 of glue called "hot melt".

FIGS. 8 to 10 show another embodiment of the primary container 49 or box obtained from the blank 50.

The box 49 is in the form of a tray, comprising a rectangular bottom 51 which comprises four first rectangular flaps equal in pairs 52 and 53 and connected respectively to each side of the bottom by means of folding lines 54 perpendicular to one another.

Two first opposite flaps 53, for example corresponding to the small sides, each comprise, on either side, second rectangular flaps 55 attached to the lateral peripheries of said first flaps.

The second flaps 55 comprise, in the lower part, rectangular recessed parts 56 of a height equal to or substantially equal to that of the board 57, which are arranged so as to allow the vertical blocking of the board 57 (cf. FIGS. 8 and 9) previously provided, on its lower face, with a plastic sheet 58, for example integrally fixed by adhesive bonding, which fits under the lower edges 59 of the second flaps 55, at the same time wedging the film 58, as shown in FIG. 9.

The film 58 thus follows a horizontal path parallel to the bottom 60 of the carcass, then a vertical path over a small lower portion 61 of the vertical wall 53 and then a horizontal path 62 toward the interior of the carcass, before emerging freely toward the toad and/or the top and the interior of said carcass, so as to be capable of subsequently folding down onto the load 63 (as represented by broken lines in the figure), as shown by the arrows 64.

In one embodiment, the means for blocking the board may even comprise, or consist of, a product to be packaged which is higher than the others and which would come into abutment on the inner face of the lid (not illustrated) when the lid is put in place.

FIGS. 11 to 13 show another embodiment of a carcass 70 for a box according to the invention, with a rectangular board 71 provided with a plastic film 72 prebonded adhesively to the lower face of the board.

The film comprises, for example, orifices or recesses 73, for example in the form of crescents of small dimension (with a maximum dimension of 0.5 cm to 3 cm, for example 1 cm), for example two rows of 10 crescents 73 (2 times 5), staggered, that is to say offset, and capable of being arranged below and in line with the edges of inner walls, specified below, or directly in the vicinity toward the interior of the carcass.

These crescents will allow direct adhesive bonding of cardboard to cardboard, as described above.

More specifically, the carcass 70, in the form of a tray, comprises four rectangular walls formed by two small flaps 74 and two large flaps 75 attached to the bottom 76 by means of folding or joining lines 77.

Each small flap comprises two rectangular lateral second flaps 78, with a lower recess 79 for blocking the board against the bottom, as described above.

These recesses are substantially rectangular with a width e between the extension of the folding line 77 and the lower edge of the flap 78, and extend over the entire length of the second flap 78.

Moreover, the second flaps 78 are adhesively bonded to the inner faces of the large flaps 75.

The large flaps 75 themselves comprise, on their upper horizontal periphery, rectangular third flaps 81 attached to the latter by means of double folding lines 82 and of a thickness equal to or a little greater than that of the second flaps 78, so as to be folded down and adhesively bonded to the outer faces 83 of the second flaps 78, said outer faces being directed toward the interior of the carcass, as illustrated in FIG. 12.

The film of plastic material 72, previously Introduced Into the formed tray or integrally fixed to the board 71 before being introduced (cf. FIG. 11), is thus wedged horizontally between the lower edges 84 of the second flaps 85 and of the third flaps over a greater horizontal distance, the width I of the third flaps being calculated to make it possible for said flap likewise to brush against and/or wedge the board against the bottom on the film of plastic material.

In practice, the third flaps may be folded only after the film and board have been introduced, thus further strengthening the blocking, thereby making it possible to transport particularly heavy objects, such as, for example, kitchen utensils.

FIGS. 14 to 17 show another embodiment of the invention.

Here, the carcass 90 is obtained from a blank 91 in the form of an enclosure provided with four rectangular tabs 92, 93, 94 and 95 forming the vertical walls of the box obtained from the carcass. A lateral adhesive bonding tongue is likewise provided in the known way.

Each tab comprises a lower flap, specifically the large tabs 92 and 94 each comprise a rectangular flap 96 intended for forming the plane contiguous face of the bottom, against which face the board 97 will be blocked, and the small tabs 93 and 95 comprise an identical flap 98 of a rectangular shape higher than that of the small adjacent tab to which it is attached.

Each flap 98 comprises a central tongue 99 detachable from said flap, but attached to the bottom by means of a folding line 100 offset relative to the aligned joining lines 101 of the flaps 92 to 95.

The formation of the half box according to the embodiment of the invention will now be described with reference to FIGS. 16A, 16B and 17 first of all, and then to FIGS. 14 and 15.

First of all, the flaps 98 (cf. FIG. 1GB) are folded at 180°, so as to lay them onto the inner faces of the tabs 93 and 95, to which they are integrally fixed, for example temporarily, by means of glue spots 102.

By contrast, the tongues 99, for example of 35 rectangular shape, remain horizontal in the same plane as the other flaps 96, an additional recess 99' thus appearing in said flaps 98.

The carcass is subsequently formed, for example round a mandrel, the large rectangular flaps 96 being above and the adhesively bonded tongues 99 below said flaps 96 (cf. FIG. 17).

The half box of FIG. 14 is then obtained.

The board 97 provided with the film 103, and, for example, having a transverse dimension a little smaller than the length between raised flaps 98 to allow its introduction, is then introduced and blocks the film 103 on the flat bottom of the box.

The flaps 98 are then folded down (arrow 104) and form the means for blocking the board 97 on the bottom, to which board they are adhesively bonded (cf. FIG. 15), the film 103 escaping on the sides, as shown in the figure.

In the preferred embodiments of the invention, the film is in one piece.

It could be in two pieces fastened on either side and leaving, between the two, a space devoid of film, allowing excellent direct adhesive bonding of the board to the bottom.

It is important that the top of the bottom be perfectly flat, in order to allow the film to have a firm hold and allow effective laying of said board onto the film, this being completed by adhesive bonding.

In the embodiments more particularly described here, the board is made of corrugated cardboard, of which the direction of the flutes is perpendicular to the contact lines with the first vertical walls, between which said board is inserted, and the board completely covers the bottom of the box, so as to form a double bottom.

A method will now be described for forming a packaging box made of cardboard or the like, for the transport of a load, of the type described above, with reference to FIG. 18 which indicates the successive steps diagrammatically.

A first step 110 involves forming the bottom and the vertical walls of the box which is left open on top.

Such formation may, for example, be carried out around a mandrel, starting from an enclosure of tabs, as described in the documents FR-A-2,629,012 or FR-A-2,665,137. The blocking means may, in this case, be either the inner blocking tabs adhesively bonded to the walls or snap~engagement means, the assembly as a whole being completed by adhesive bonding through the plastic film or plastic films.

A composite element is then formed (step 111) comprising the board and the plastic material previously integrally fixed, at least temporarily, to said board by adhesive bonding (step 112).

The composite element is subsequently introduced into said box, for example by being pushed forcibly or aslant (step 113), until it comes into a blocking position in abutment against the bottom of the box, the free edges of the plastic film being kept toward the outside, if necessary, for example by means of blowing nozzles.

The load is subsequently placed in the pack (step 114), the ends of the plastic film are closed on top (115), said plastic film being hot-welded at 116, and then heat-shrinkage is carried out (step 117) for example by a passage through a heating tunnel in a way known per se.

The pack is subsequently closed (step 118), by arranging the lid and/or by closing said pack simply by adhesive bonding, where upper flaps are concerned, before the pack is evacuated (119).

Another method involves introducing the plastic film before the board is introduced.

It thus has better retention of the film of plastic material when the board is being put in place.

In an advantageous embodiment, in which a mandrel is used before the bottom and the walls of said box are formed, the composite element is laid onto the bottom of the mandrel and the box is subsequently formed on top.

It is also possible to form the bottom and part of the vertical walls of the box, which is left open on the side, to form the composite element, comprising the board and the plastic material integrally fixed, at least temporarily, to said board, and to introduce the composite element into said box from the side before said side is closed, to put the load in place, to carry out heat-shrinkage and to put in place the lid of the carcass.

The invention also proposes an apparatus for the production of a packaging box made of cardboard or the like, for the transport of a load, said box comprising a lateral enclosure formed from at least four vertical walls and from a horizontal bottom integrally fixed to the enclosure via joining lines, and a filmlike heat-shrinkable plastic material intended for packaging said load and for keeping the latter in place.

The apparatus will now be described with reference to FIG. 19.

The means which it employs are a combination of means which are known and/or are suitably adapted to be within the scope of the average person skilled in the art seeking to mechanize the production of a carcass according to the invention, such as machines for the formation of polygonal trays and/or carcasses of four or eight sides round a mandrel.

The novelty arises, in particular, from the use of these machines in combination, making it possible to obtain the pack according to the invention.

The apparatus therefore comprises means 120 for forming the bottom and the vertical walls of the box C from blanks F supplied in a known way, and means 121 for presenting a composite element comprising a board 122 superposed on the filmlike plastic material 123 which is advantageously integrally fixed, at least temporarily, to said board.

The means 121 compromise, for example, a film unwinder 124, means 125 for the piercing of orifices, for example by heating, and means 126 for delivering the cardboard board 122 above the film, with adhesive bonding by injection means 127, and means 128, comprising, for example, a rocker arm or a piston, for introducing the composite element forcibly or aslant into said box until said composite element lays the heat~shrinkable film onto the inner face of the bottom of the box, allowing curtain portions of free material to escape, and be held (rollers 129), on either side of two mutually confronting opposite edges of said board, said curtain portions extending from said edges over a length sufficient to cover one another, at the same time completely enveloping the load and blocking said load as a result of the heat-shrinkage of the film when they are folded down.

The box itself comprises the means capable of laying said element in place by pressing on the attached rigid board.

The apparatus also comprises means 131 for putting the load in place, means 130 for folding the film parts down onto the load, and means 132 for the heat sealing of said film parts to one another.

It comprises, subsequently, means 133 for the heat-shrinkage of the film and for closing by means of a lid 134 or for folding down an adhesively prebonded flap by means 135.

In a variant in which the pack is formed round a mandrel, the means 128 are replaced by means for laying the composite element onto the bottom of the mandrel, before the box is formed round said composite element.

What is claimed is:

1. Packaging box made of cardboard for the transport of a load, said box comprising a lateral enclosure formed from at least four vertical walls and from a horizontal bottom integrally fixed to said enclosure via joining lines, a heat-shrinkable plastic material intended for packaging the load and for keeping the load in place, at least one attached board inserted between at least two first opposite vertical walls, in such a way that the transverse edges are in contact, via the heat-shrinkable plastic material, with at least part of the joining lines of said first walls, and means for blocking the at least one board against the bottom, wherein the at least one board presses the heat-shrinkable plastic material onto the inner face of the bottom of the box, at the same time allowing curtain portions of free material to escape on either side of two mutually confronting transverse opposite edges of the at least one board, said curtain portions extending from said transverse edges over a length sufficient to cover one another with the heat shrinkage of the plastic material, and in that, in order at least partially to form blocking means, the lower face of the at least one board is at least partially directly adhesively bonded to the upper face of the bottom of the box, through at least one recess of the film or on a surface devoid of heat-shrinkable plastic material.

2. Packaging box according to claim 1, wherein the blocking means at least partially include said first walls, the at least one board having a dimension a little greater than the distance between said first walls, so that the at least one board can only be introduced and then wedged forcibly between said first walls.

3. Packaging box according to claim 1, wherein, in order at least partially to form the blocking means, the at least one board comprises, on at least one of its two opposite edges, at least one tenon co-operating with a corresponding recess made in the region of the joining line with the bottom of the first confronting wall, in order to bring about the snapping engagement of the at least one board, once the at least one board is in place against the bottom of the box.

4. Packaging box according to claim 3, wherein the recess comprises a groove of a height at least equal to the thickness of the at least one board and extending over part of the length of said joining line.

5. Packaging box according to claim 1, wherein the blocking means comprise portions of inner tabs directly adhesively bonded to the inner faces of said first vertical walls, the lower periphery of said inner tabs coming into abutment with the upper edges of the board in order to ensure said blocking.

6. Packaging box according to claim 1, wherein the blocking means comprise flaps attached to the upper peripheries of the first walls by means of folding lines.

7. Packaging box according to claim 1, wherein the blocking means comprise flaps attached to the lateral peripheries of the second walls adjacent to the first walls.

8. Packaging box according to claim 1, wherein the blocking means comprise flaps attached to the lower peripheries of the first walls by means of folding lines forming the joining lines with the bottom, said flaps each comprising a tongue detachable from said flap, but remaining attached to said joining lines a nd being fastened to the bottom of the box formed by two other flaps, said flaps being folded down over the at least one board.

9. Packaging box according to claim 1, wherein the heat-shrinkable plastic material is in one piece.

10. Packaging box according to claim 1, wherein the at least one board is made of corrugated cardboard, of which the direction of the flutes is perpendicular to the contact lines with the first vertical walls, between which said at least one board is inserted.

11. Packaging box according to claim 1, wherein the at least one board completely covers the bottom of the box in order to form a double bottom.

12. Packaging box according to claim 1, wherein the box is produced from a blank comprising a series of tabs which terminates in a fastening tongue, said tabs being connected to one another by means of first folding lines parallel to one another, and a first set of lateral flaps arranged on one side and connected to the main tabs by means of second folding lines which form said joining lines, are perpendicular to the first folding lines and are intended at least partially for forming the bottom of the box, said second folding lines being aligned, and said box being arranged so as to be assembled automatically by the folding down of said tabs and of the flaps of said first set around a mandrel, the end tab of the series of tabs and the tongue, on the one hand, and the adjacent flaps, on the other hand, being fastened to one another by adhesive bonding in order to form said box.

13. Packaging box according to claim 12, wherein the series comprises eight tabs comprising four main tabs separated in pairs by four intermediate tabs.

14. Method for forming a packaging box made of cardboard for the transport of a load, according to claim 1, in which the bottom and the vertical walls of the box, which is left open on top, are formed, the plastic film a nd the at least one board being placed in the box simultaneously or separately, the at least one board being adhesively bonded to the bottom of the box through orifices made in the plastic film.

15. Method according to claim 14, wherein a composite element is formed, comprising the at least one board and the plastic material integrally fixed at least temporarily to said at least one board, the film having previously been perforated in order to form a plurality of orifices which are aligned or staggered in parallel and are substantially in the vicinity of those edges of the at least one board which are likely to confront the lines joining the bottom with the first walls, glue is injected through these orifices onto the cardboard of the at least one board, located underneath, and the composite element is introduced forcibly or aslant into said box until it comes into a position blocked in abutment against the bottom of the box, before the top of said box is closed by flaps being folded or a lid being put in place, after the introduction of the load and heat sealing.

16. Method according to claim 14, wherein the plastic material, previously perforated in order to form at least one orifice, is introduced, and glue is injected through this orifice onto the cardboard of the bottom underneath, the at least one board is then introduced forcibly onto the plastic material, until it comes into a position blocked in abutment against the bottom of the box, before the rear is closed, after the introduction of the load and heat sealing.

17. Method according to claim 14 for forming a box, wherein the bottom and the walls of the box are formed around a mandrel.

18. Method according to claim 17, wherein, before the bottom and the walls of said box are formed the composite element is laid onto the bottom of the mandrel, and the box is subsequently formed from above.

19. Method according to claim 14, wherein the bottom and part of the vertical walls of the box, which is left open on the side, are formed, a composite element is formed, comprising the at least one board and the plastic material integrally fixed at least temporarily to said at least one board, and the composite element is introduced into said box from the side, before the box is closed after the load has been put in place and heat sealing.

* * * * *

UNITED STATES PATENT AND TRADEMARK OFFICE

CERTIFICATE OF CORRECTION

PATENT NO. : 6,216,871 B1
DATED : April 17, 2001
INVENTOR(S) : Bacques et al.

It is certified that error appears in the above-identified patent and that said Letters Patent is hereby corrected as shown below:

Column 14,
Line 45, insert -- at least one -- before the word "board"
Line 46, delete "said" after the word "ensure"

Column 16,
Line 16, "rear" should read -- box --

Signed and Sealed this

Twenty-second Day of October, 2002

*Attest:*

*Attesting Officer*

JAMES E. ROGAN
*Director of the United States Patent and Trademark Office*